United States Patent [19]

Prandini

[11] 3,948,276

[45] Apr. 6, 1976

[54] SYSTEM FOR FEEDING PAIRS OF CIGARETTES WITH AN INTERPOSED DOUBLE LENGTH FILTER PLUG, DIRECTLY FROM A MAKER TO A PACKER

[75] Inventor: Dante Prandini, Reggio Emilia, Italy

[73] Assignee: AMF Incorporated, White Plains, N.Y.

[22] Filed: Apr. 25, 1974

[21] Appl. No.: 464,087

[30] Foreign Application Priority Data

June 14, 1973 Italy ..... 12670/73

[52] U.S. Cl. ..... 131/25; 131/20 R

[51] Int. Cl.[2]... A24C 1/14; A24C 1/44; A24C 5/33; A24D 1/10

[58] Field of Search..... 131/21 R, 21 A, 25, 94; 198/20 C; 53/55, 59 R, 151

[56] References Cited

UNITED STATES PATENTS

| | | | |
|---|---|---|---|
| 1,168,795 | 1/1916 | Ewers | 131/25 X |
| 1,764,663 | 6/1930 | Voigt | 53/59 R |
| 2,284,117 | 5/1942 | Best | 131/25 X |
| 2,330,000 | 9/1943 | Molins | 131/25 |
| 2,334,142 | 11/1943 | Arelt | 53/151 X |
| 2,745,410 | 5/1956 | Molins | 131/21 R |
| 2,902,040 | 9/1959 | Korber et al. | 131/94 |
| 2,942,606 | 6/1960 | Rowlands | 131/94 |
| 2,988,198 | 6/1961 | Pinkham | 131/94 UX |
| 2,989,055 | 6/1961 | Labbe | 131/21 A |
| 3,067,754 | 12/1962 | Pinkham et al. | 131/94 X |
| 3,596,797 | 8/1971 | Wallenborn | 131/21 A X |
| 3,625,103 | 12/1971 | Giatti | 198/20 C UX |
| 3,690,149 | 9/1972 | Pezzi | 73/38 |

FOREIGN PATENTS OR APPLICATIONS

| | | | |
|---|---|---|---|
| 662,003 | 7/1938 | Germany | 131/21 A |

*Primary Examiner*—Robert W. Michell
*Assistant Examiner*—V. Millin
*Attorney, Agent, or Firm*—George W. Price; Charles J. Worth

[57] ABSTRACT

A method and apparatus for providing a direct link-up between a cigarette maker which produces cigarette assemblies each comprising a pair of cigarettes connected together in end to end alignment and a packer which packages groups of individual cigarettes, the link-up having a reservoir for cigarette assemblies which are delivered one by one at a rate determined by the packer, means for dividing cigarette assemblies into individual cigarettes which are arranged in an aligned row providing a continuous flow of cigarettes which are inspected and selectively delivered in accordance with the inspection to the packer.

11 Claims, 3 Drawing Figures

SYSTEM FOR FEEDING PAIRS OF CIGARETTES WITH AN INTERPOSED DOUBLE LENGTH FILTER PLUG, DIRECTLY FROM A MAKER TO A PACKER

This invention relates generally to continuous cigarette making and packaging systems and, more particularly to the so-called direct link-up between a cigarette maker and a packer which produces packs of cigarettes as the cigarettes being packaged are being made.

In the known direct link-ups between a cigarette maker and a packer, individual filter tip cigarettes are directly transferred from one machine to the other without the use of transferring containers into which groups of cigarettes have been previously collected. Obviously, the single cigarettes so transferred could also be made without filter plugs.

One object of the present invention is a method for the direct and continuous cigarette transfer from a maker to a packer in which the cigarettes to be packed are transferred while they are aligned in assemblies each assembly consisting of two cigarettes and an interposed filter plug attached to both cigarettes by means of a tipping material patch which engages the filter plug and the cigarette ends abutting it. Each filter plug is equal in length to the filters of two completed filter tip cigarettes.

Another object of the present invention is to provide apparatus which comprises mechanical transferring means engaging each assembly of two cigarettes and the interposed filter plug in the area of the double length filter plug; and means for separating, orienting and inspecting the cigarettes, immediately upstream of the packer and in direct operative alignment with it, to reject the defective cigarettes while the others which are acceptable follow the normal path of the system and are directly and continuously transferred to the packer.

And another object of the present invention is to provide the foregoing apparatus which further comprises storage means capable of accommodating suitable quantities of assemblies of three items in case the packer stops while the maker goes on producing cigarettes.

The foregoing and other objects and advantages will appear more fully hereinafter from a consideration of the detailed description wherein one embodiment of the invention is illustrated by way of example. It is to be expressly understood, however, that the drawing is for illustration purposes only and is not to be construed as defining the limits of the invention.

Figure 1:
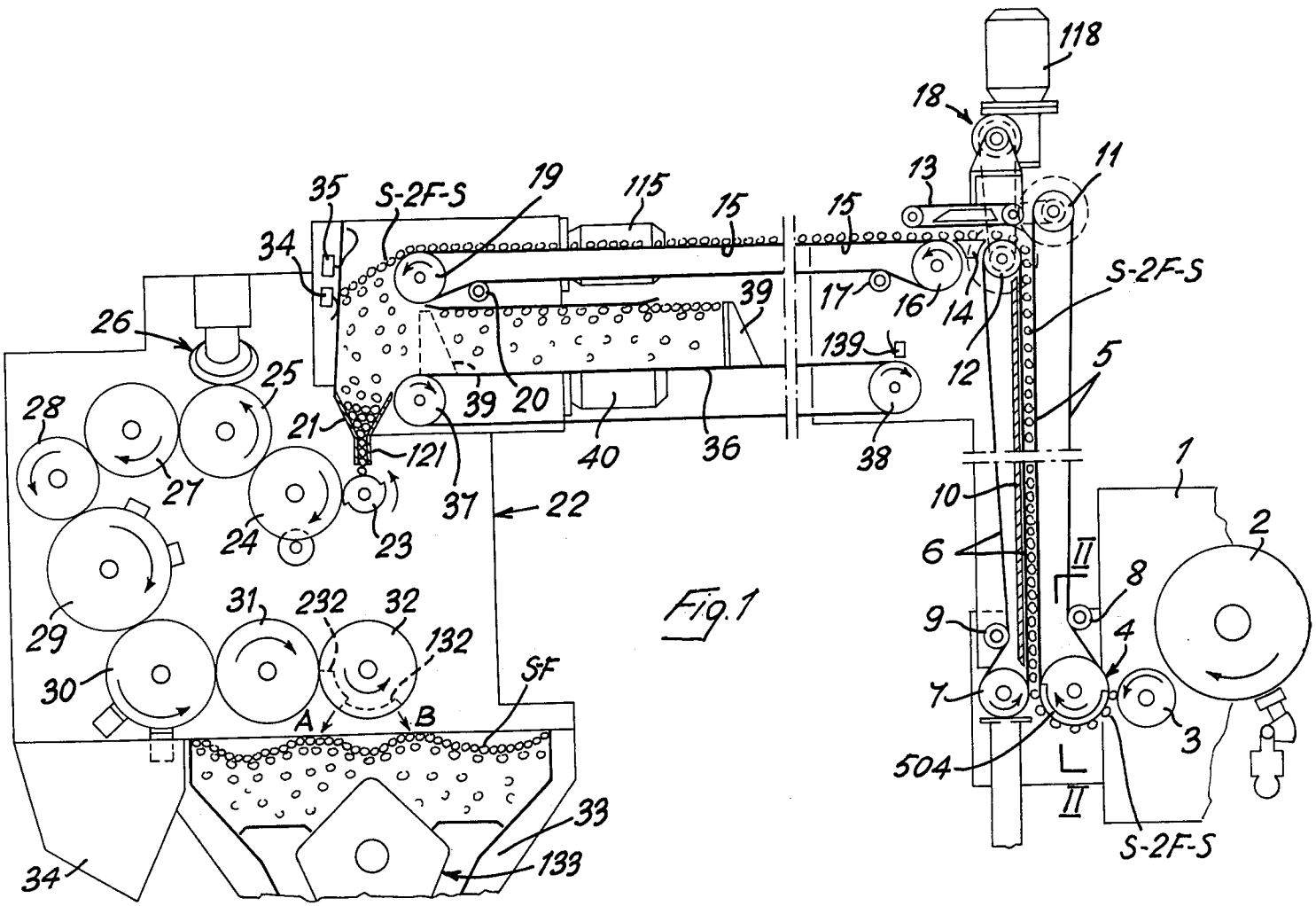
FIG. 1 is a diagrammatic side elevational view of linking apparatus between a cigarette maker and packer made in accordance with the present invention.

Referring now to the drawings and particularly to FIG. 1, a cigarette maker 1 is provided with delivery members 2 and 3 which transfers a substantially steady stream of cigarette assemblies S-2F-S to a vacuum type receiving drum 4. Each cigarette assembly S-2F-S consists of two axially aligned cigarettes S with a filter plug

2F interposed therebetween and attached to the adjacent ends of the cigarettes by a gummed tipping material patch in any usual manner well known in the art. Each filter plug 2F has an axial length equal to twice the length of a filter connected to the end of a cigarette.

The drum 4, in turn, transfers the cigarette assemblies S-2F-S to an elevator means formed by a pair of spaced elongated parallel runs provided by a pair of endless belts 5 and 6.

The lower end of belt 5 is supported by the drum 4 and spaced therefrom is a roller 11 which supports the upper end of the belt. The belt 6 is supported by a lower roller 7 and an upper roller 12 spaced from the lower roller while a pair of tensioning rollers 8 and 9 are provided to tension the belts 5 and 6, respectively. The outer faces of the belts 5 and 6 are preferably coated or made of a soft spongy material M (see FIG. 2) for providing a gentle holding action on the cigarette assemblies S-2F-S so the cigarettes of the assemblies are not deformed as they are lifted by the ascending, concordant and uniform motion of the parallel belt runs. The active or parallel run of the belt 6 is guided along an upright or vertical plate 10 and cigarette assemblies S-2F-S are lifted in the space between the active or parallel runs of tapes or belts 5 and 6, being gently held by the soft material M provided on the outside faces of said tapes. It should be noted that the provision of such soft material M obviates the necessity of holding the cigarette assemblies by pneumatic suction through one or the other of said tapes.

Figure 2:
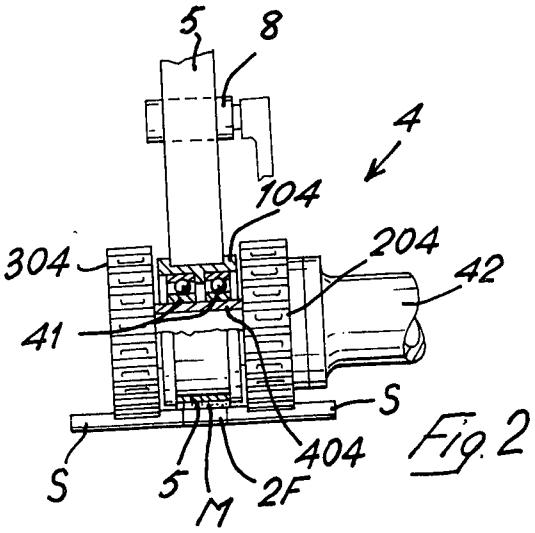
FIG. 2 is an enlarged elevational view with a portion broken away taken on line II — II of FIG. 1 illustrating the means for transferring cigarette assemblies from the maker to the linking apparatus.

As shown in FIG. 2, the receiving drum 4 basically consists of a pair of pneumatic fluted rings 204 and 304 axially spaced from one another with the flutes of one ring axially aligned. The rings 204 and 304 are mounted on a hollow hub 404 connected to the end of a hollow or tubular shaft 42. The shaft 42 rotatably drives rings 204 and 304 at a rate determined by the maker 1 and is connected to a source of suction (not shown) which is selectively connected to the flutes of the rings to hold cigarette assemblies S-2F-S as such flutes course an arcuate path 504 (see FIG. 1) where suction is effective in the bottoms of such flutes.

A pair of bearings 41 are mounted on the hub 404 between the fluted rings 204 and 304, and, in turn, mount a pulley 104 which engages and guides the lower end of the endless belt or tape 5. The width of the belt or tape 5, as shown, and preferably the belt or tape 6, is slightly larger than the axial length of the filter plug 2F and engages each cigarette assembly S-2F-S in the area of the filter plug.

At the top of the elevating path formed by the space between the parallel runs of belts of tapes 5 and 6 cigarette assemblies S-2F-S are transferred to a substantially horizontal transfer path provided by the upper or top run of an endless tape 15 which extends between a spaced pair of end rollers 16 and 19 and is kept taut or under tension by tensioning rollers 17 and 20. The tape or belt 15 is driven by a motor means 115 while a motor 118 is provided with a geared output means 18 for synchronously driving the tapes or belts 5 and 6 so that their spaced parallel runs move upwardly at a common uniform speed. A stationary bridge 14 is disposed between the rollers 12 and 16 to provide a connecting path for the cigarette assemblies S-2F-S between the belts 6 and 15. The motor 118 through its geared output 18 also drives a horizontally disposed endless belt 13 which is spaced above the rollers 12 and 16, the stationary bridge 14 and a portion of the belt 15 to assist the cigarette assemblies S-2F-S moving vertically in the path between belts 5 and 6 to change to the horizontal path provided by the belt 15.

At the discharge end of the belt or tape 15, cigarette assemblies S-2F-S drop into feed hopper 21 which has one or more discharge channels 121. Each channel 121 is shaped so that cigarettes assemblies S-2F-S move individually towards and into an underlying box or housing 22 which includes all the devices necessary to separate each cigarette assembly into a pair of single cigarettes S-F as well as to handle and test the cigarettes before they are directly and regularly distributed to the hopper 33 of a packer 133 if acceptable while the cigarettes which have proved to be defective during the tests, are discharged through chute 34.

As illustrated as an example in the drawings the hopper 21 is provided with a single discharge channel 121 which feeds cigarette assemblies S-2F-S one at a time in succession to a two lobe rotatable extractor device 23. The extractor 23 feeds the cigarette assemblies S-2F-S as they are received from the channel or chute 121 to a cutter drum 24 such as drum 1 of U.S. Pat. No. 3,625,103 granted Dec. 7, 1971 to F. Giatti and assigned to the same assignee as the present application. The filter plugs 2F are cut into two equal lengths thereby dividing each cigarette assembly into two axially aligned filter tip cigarettes S-F disposed oppositely to one another with the filter tips positioned adjacent to one another.

Figure 3:
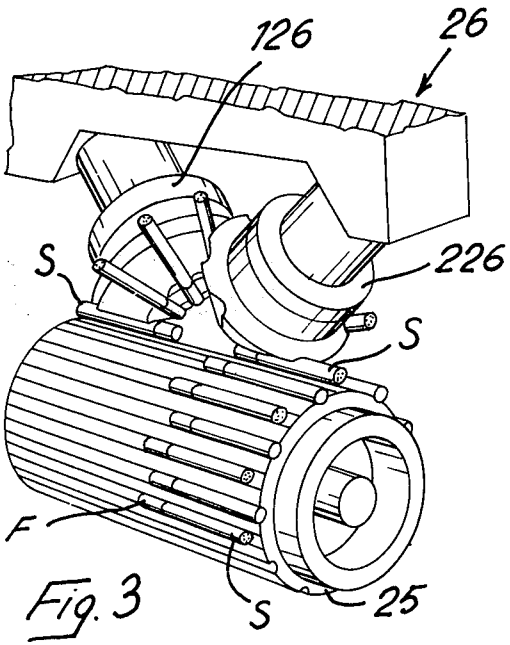
FIG. 3 is an enlarged perspective view of the cigarette turn around device embodied in the linking apparatus of FIG. 1.

These single filter tip cigarettes S-F are transferred in two rows to a pneumatic fluted drum 25 forming part of a turn-around device 26 which may be, as an example, of the type described the aforementioned U.S. Pat. No. 3,625,103. The purpose of the turn-around device is to receive the two rows of cigarettes S-F as a result of cutting assemblies S-2F-S in cutter 24 (see for example cutter 2 of U.S. Pat. No. 3,625,103), and to arrange the cigarettes in a single row with the filter tips facing the same way. As shown in perspective in FIG. 3, the pneumatic rotary fluted cone 126 of the turn-around device 26 picks up successive cigarettes S-F of one row from the drum 25 transfers them to the associated fluted cone 226. The cone 226, in turn, returns the cigarettes S-F to the drum 25. The cigarettes S-F returned to the drum 25 are oppositely oriented to their original orientation, that is to say that the filter tip position is reversed, and the cigarettes are deposited between the cigarettes of the other row.

All of the cigarettes S-F now arranged in a single row are transferred from the drum 25 to a drum 27 where they are aligned. The aligned cigarettes S-F are then transferred from the drum 27 to the transfer drum 28 of a suitable device for inspecting the cigarettes before they are packed. This inspection device, for example, may be of the type described in U.S. Pat. No. 3,690,149 granted Sept. 12, 1972 to G. Pezzi and assigned to the same assignee as the present invention. While the foregoing patent teaches the use of an electropneumatic inspection device, as an alternative or in addition thereto a cigarette end inspection device may be provided. The drum 28 transfers the cigarettes S-F to a drum 29 which represents the actual inspection station or stations depending upon the particular cigarette inspection equipment utilized.

After inspection, the cigarettes S-F are transferred from the inspection station 29 to a sorting drum 30 where defective or reject cigarettes, as determined by the inspection apparatus, are discharged through a chute 34. The cigarettes S-F which prove to be suitable for packaging, as determined by the inspection apparatus, are transferred from the sorting drum 30 by a transfer drum 31 to a distributing means which regularly distributes the cigarettes into the hopper 33 of a packer 133. The drums 29, 30 and 31 may be of any suitable conventional construction well known in the art such as pneumatic fluted drums capable of supporting cigarettes at their peripheries.

The distributing device comprises a pneumatic fluted drum 32 in which the alternate drum flutes communicate with two distinct suction areas 132 and 232. In other words, while the suction holes of a flute communicates with one of said suction areas, suction holes of the adjacent flutes communicate with the other suction area and so on for the other flutes of the distributing drum. By so doing, the distribution of cigarettes S-F to hopper 33 is accomplished in two radial directions A and B (see FIG. 1) symmetrically spaced from each other on opposite sides of a vertical.

Before normal machine operation start-up the feed hopper 21 is filled in an orderly manner with cigarette assemblies S-2F-S to a level where the usual or conventional level detector 34 is actuated. Such a detector can be a conventional switch, as shown, mechanically operated by the weight of the cigarette assemblies accumulated in the hopper or a photoelectric cell device or the like.

The holding or storage capacity for cigarette assemblies S-2F-S is not limited to the capacity of the hopper 21. A horizontal endless belt or tape 36 is spaced below the belt 15 and is mounted under tension on a pair end rollers 37 and 38. The upper run of the belt 36 is radiused around the roller 37 to the upper edge of the flared wall of the hopper 21 to facilitate movement of cigarette assemblies S-2F-S between the upper run of the belt and the hopper. A vertical support 39 is mounted on the upper run of the endless belt 36 and bidirectional drive means 40 is provided to drive the belt 36 and move the support 39 toward or away from the hopper 21 to increase or decrease the area in the novel link-up for holding or storing cigarette assemblies S-2F-S.

The operative correlation or relative production speeds of the maker 1 and the packer 133 preferably is adjusted so that during normal machine operation the level of cigarette assemblies S-2F-S in the hopper 21 remains substantially constant because of the uniformity between the rate of feed of cigarette assemblies from the maker 1 to the hopper 21 and the rate of discharge of the cigarette assemblies from the hopper.

It should be understood that the speed or operation rates of the equipment in the case 22 consisting of the extractor 23, the cutter 24, the turn-around 26, the alignment means 27, the inspection means 28 and 29, the sorting means 30 and the distributing means 31 and 32 are all correlated to the production rate or determined by the speed of the packer 133.

When the packer 133 stops and the maker 1 continues to produce cigarette assemblies, or if the relative production speeds change so the maker is operating faster than the packer, the level of the cigarette assemblies S-2F-S in the hopper 21 will rise above the normal level to a point where an excess level detector 35 will be actuated. Like the detector 34, the excess level detector 35 can be a mechanically operated switch, a photoelectric device or any other suitable means known in the art. Actuation of the excess level detector 35 energizes the drive means 40 causing the belt 36 to run in a direction which moves the support 39 away from the hopper 21 providing a progressively enlarging reservoir which supplements the capacity of the hopper. The movement of the belt 36 and the support 39 is limited by a limit switch 139 or an equivalent detector which when actuated stops the maker 1. If relative operating imbalance between the maker 1 and packer 133 is corrected, the level of cigarette assemblies S-2F-S will drop to a level where the excess level detector 35 is reset and the drive means 40 is deactivated.

If the maker 1 stops while the packer 133 is running, the consequent lowering of the cigarette level in the hopper 21 below level detector 34, resets the level detector itself. This causes tape or belt 36 to move from the generic position of paddle 39, indicated with continuos lines in FIG. 1, to the position in which said paddle is illustrated by broken lines and which corresponds to the condition of complete emptying of the reservoir. During this displacement, the cigarette assemblies S-2F-S which have accumulated on said reservoir are progressively discharged into hopper 21, thus maintaining the feed to the finishing unit 22 associated to the packer 133.

The method according to the invention allows to transfer two cigarettes at a time from the maker to the packer, holding them by the double filter which, being in the middle between the cigarettes associated with it, constitutes a balanced hold which is quite suitable for very high transfer speeds involved by modern and high output systems. During this transfer, the body of the cigarettes is not handled, thus eliminating or at least limiting the loss of tobacco leaking out of the assembled cigarette ends. Furthermore, the reservoir or storage area on tape 36 could contain, with the same length, a number of cigarettes twice as great as that which it would contain if single filtertip cigarettes were conveyed.

Finally, cigarette inspection takes place immediately before the cigarettes, already separated into two elements by cutting transversely the assembly, are introduced into the packer proper. This ensures that the cigarettes are actually suitable for packing.

Although a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

I claim:

1. A method of linking a cigarette maker producing cigarette assemblies consisting of cigarettes connected together in pairs in end to end alignment, to a packer, comprising the steps of;

transferring cigarette assemblies from the maker to a reservoir means including initially elevating the cigarette assemblies above the reservoir means by engaging opposite sides of only the center portions of the cigarette assemblies with a pair of spaced endless belts each of which runs at the same speed as the other;

sensing the level of cigarette assemblies in said reservoir means and varying the volume of said reservoir in response to said level sensing to maintain a substantially constant level of cigarette assemblies in the reservoir, and stopping the maker when the volume of the reservoir is at its maximum and is filled to a predetermined level;

removing the cigarette assemblies from the reservoir means one by one at a rate determined by the speed of the packer;

dividing the cigarette assemblies removed from the reservoir means into pairs of separate cigarettes and assembling the cigarettes into a single aligned moving row providing a continuous flow of cigarettes; and inspecting the flow of cigarettes and transferring only cigarettes found by such inspection to be acceptable for packaging to the packer.

2. The method in accordance with claim 1, in which the cigarette assemblies include a filter plug at the center portion thereon, comprising the step of dividing the filter plugs into halves when the cigarette assemblies are cut thereby providing each cigarette with a filter tip.

3. The method in accordance with claim 2, further comprising the step of rotating one cigarette of each pair after the filter plug thereof has been divided so all of the filter tips are disposed on the same side of the single aligned row of cigarettes.

4. Apparatus providing a direct link-up between a cigarette maker producing cigarette assemblies of pairs of cigarettes, and a packer, comprising:

reservoir means including a hopper for receiving and holding cigarette assemblies;

transfer means for receiving cigarette assemblies from the maker and for transporting the assemblies to the reservoir means;

said transfer means including a fluted vacuum drum receiving cigarette assemblies from the cigarette maker and having two axially spaced areas of vacuum acting on the cigarette assemblies, and a pair of vertically disposed endless belts each having a vertical run in spaced face to face relationship with a vertical run of the other belt providing an elevator means receiving cigarette assemblies from said drum and transporting such assemblies to a horizontally disposed conveyor.

each of said pair of belts being driven at the same speed as the other belt and being of limited width for engaging only the center portions of said cigarette assemblies which extend beyond both sides of said belts;

means for removing cigarette assemblies from the hopper one by one at a rate determined by the operating speed of the packer;

means for receiving the cigarette assemblies as they are removed from said hopper and cutting said assemblies into pairs of cigarettes of equal lengths aligned axially with one another;

means for forming a single aligned row of cigarettes each moving laterally to its axis;

means for inspecting each of the cigarettes and removing unacceptable ones from the aligned row of cigarettes; and means for transferring the remaining cigarettes to the packer thereby providing a substantially continuous flow of acceptable cigarettes to be packaged.

5. Apparatus in accordance with claim 4, and said fluted drum comprising a pair of axially spaced fluted rings disposed on a common support, and one end of one of said pair of endless belts being disposed between said fluted rings.

6. Apparatus in accordance with claim 5 and said reservoir means further comprising:

a substantially horizontal endless belt having one end disposed adjacent the top of said hopper;

a vertical support mounted on the upper run of said endless belt;

level sensing means for sensing the level of cigarette assemblies in said reservoir means, and means for driving said belt and for moving said vertical support towards and away from said hopper in response to said level sensing means thereby varying the volume of said reservoir means for storing cigarette assemblies.

7. Apparatus in accordance with claim 6, further comprising:

limit means for determining when said vertical support has reached its maximum distance of travel from said hopper and providing a signal to stop the cigarette maker.

8. Apparatus providing a direct link-up between a cigarette maker producing cigarette assemblies each consisting of a filter plug connected between equal lengths of cigarette rods, and a packer comprising:

reservoir means including a hopper for receiving and holding cigarette assemblies;

transfer means for receiving cigarette assemblies from the maker and for transporting the assemblies to the reservoir means;

said transfer means including a fluted vacuum drum receiving cigarette assemblies from the cigarette maker and having two axially spaced areas of vacuum acting on the cigarette rod portions of such assemblies and a pair of vertically disposed endless belts each having a vertical run in spaced face to face relationship with a vertical run of the other belt providing an elevator means receiving cigarette assemblies from said drum and transporting such assemblies to a horizontally disposed conveyor;

each of said pair of belts being driven at the same speed as the other belt and engaging the filter plugs of said cigarette assemblies;

means for removing cigarette assemblies from the hopper one by one at a rate determined by the operating speed of the packer;

means for receiving the cigarette assemblies as they are removed from said hopper and cutting each filter plug into halves providing a pair of axially aligned filter tip cigarettes of equal lengths from each assembly with the filter tip of one cigarette of each pair being disposed adjacent the filter tip of the other;

means for forming a single aligned row of cigarettes moving laterally to their axes, and including means for turning one cigarette of each pair so all of the filter tips are disposed on the same side of said aligned row of cigarettes;

means for inspecting each of the cigarettes and removing unacceptable ones from the aligned row of cigarettes; and means for transferring the remaining cigarettes to the packer thereby providing a substantially continuous flow of acceptable cigarettes to be packaged.

9. Apparatus in accordance with claim 8, and said fluted drum comprising a pair of axially spaced fluted rings disposed on a common support, and one end of one of said pair of endless belts being disposed between said fluted rings.

10. Apparatus in accordance with claim 9 and said reservoir means further comprising a substantially horizontal endless belt having one end disposed adjacent the top of said hopper;

a vertical support mounted on the upper run of said belt, level sensing means for sensing the level of cigarette assemblies in said reservoir means, and means for driving said belt and for moving said vertical support toward and away from said hopper in response to said level sensing means thereby varying the volume of said reservoir means for storing cigarette assemblies.

11. Apparatus in accordance with claim 10, further comprising limit means for determining when said vertical support has reached its maximum distance of travel from said hopper and providing a signal to stop the cigarette maker.

* * * * *